US007325435B2

(12) United States Patent
Hamel et al.

(10) Patent No.: US 7,325,435 B2
(45) Date of Patent: Feb. 5, 2008

(54) METHOD OF MANUFACTURING, APPARATUS AND RESULTING IRREGULAR SHAPED CROSS SECTION TUBES

(75) Inventors: Kevin Hamel, Madison Heights, MI (US); Kalyan Palanisamy, Troy, MI (US); Charles Louis Palms, Gross Pointe, MI (US)

(73) Assignee: Noble International, Ltd., Warren, MI (US)

( * ) Notice: Subject to any disclaimer, the term of this patent is extended or adjusted under 35 U.S.C. 154(b) by 0 days.

(21) Appl. No.: 11/548,150

(22) Filed: Oct. 10, 2006

(65) Prior Publication Data

US 2007/0107486 A1 May 17, 2007

Related U.S. Application Data

(60) Provisional application No. 60/736,972, filed on Nov. 15, 2005.

(51) Int. Cl.
*B21D 39/02* (2006.01)
*B21C 37/06* (2006.01)

(52) U.S. Cl. ..... 72/370.04; 72/368; 72/389.1; 72/389.2; 72/398

(58) Field of Classification Search ..... 72/368, 72/370.1, 370.4, 370.26, 389.1, 381.2, 398; 29/428, 521
See application file for complete search history.

(56) References Cited

U.S. PATENT DOCUMENTS

| | | | | |
|---|---|---|---|---|
| 652,658 | A * | 6/1900 | Bischoff | 72/368 |
| 1,387,199 | A | 8/1921 | Small | |
| 1,879,078 | A * | 9/1932 | Carlsen | 72/368 |
| 2,115,441 | A | 4/1938 | Black | |
| 2,889,866 | A * | 6/1959 | Braun | 72/368 |
| 3,719,985 | A * | 3/1973 | Federspill | 72/370.04 |
| 4,083,221 | A * | 4/1978 | Whitted | 72/370.04 |
| 4,339,941 | A * | 7/1982 | Taira et al. | 72/368 |
| 4,395,900 | A * | 8/1983 | Saurenman | 72/368 |
| 5,104,026 | A * | 4/1992 | Sturrus et al. | 72/370.01 |
| 5,657,922 | A | 8/1997 | Lowery et al. | |
| 5,924,316 | A * | 7/1999 | Streubel et al. | 72/368 |
| 7,231,792 | B2 * | 6/2007 | Shitamoto et al. | 72/368 |

FOREIGN PATENT DOCUMENTS

GB 129983 10/1920

* cited by examiner

*Primary Examiner*—David B Jones
(74) *Attorney, Agent, or Firm*—Rader, Fishman & Grauer PLLC

(57) ABSTRACT

A method and apparatus for making a tube having an inverted cross section and the resulting tube made thereby.

8 Claims, 2 Drawing Sheets

METHOD OF MANUFACTURING, APPARATUS AND RESULTING IRREGULAR SHAPED CROSS SECTION TUBES

RELATED U.S. APPLICATION DATA

The present application claims the benefit of U.S. Provisional Application Ser. No. 60/736,972, titled "Press-Forming Method of Manufacturing, Related Apparatus and Resulting Irregular Shaped Cross Section Tubes," filed on Nov. 15, 2005, incorporated herein by reference.

BACKGROUND OF THE INVENTION

1. Field of the Invention

The present invention relates to a method of manufacturing and apparatus for manufacturing an irregular shaped cross section tube and to the resulting irregular shaped cross section tube.

The present invention further relates to a method of manufacturing and modular tool die for manufacturing irregular shaped cross section tubes and the resulting irregular shaped cross section tubes.

The present invention relates to a method of manufacturing an irregular shaped cross section tube structure and a die with a removable, integral mandrel that forms tubular structures having irregular cross sections without hydroforming, and to the resulting irregular shaped cross section tubes.

The present invention relates to a method of manufacturing and apparatus for manufacturing an elongated tubular frame member with irregular cross section and localized work hardening to provide significantly improved crash force absorption when employed in vehicle construction, and to the resulting irregular shaped cross section tubes formed thereby.

The present invention further relates to a method of manufacturing a tubular member having an irregular cross section and apparatus for manufacturing a tubular structural member having an irregular cross section for use in a vehicle from a blank of metal wherein features, holes and localized hardening are made in the blank prior to forming the blank into a tubular structural member with irregular cross section.

2. Description of the Related Art

Small, U.S. Pat. No. 1,387,199 is directed to a method of making tubes or bushings of practically any length that comprises taking a metal blank of desired dimensions, bending a blank to a tubular form with the longitudinal edges in juxtaposition, then drawing the form so as to flow the metal and set the edge in closer firm abutting relation. The tube is formed by means of a pair of dies that gives the blank a U shape and then subjecting the U shaped blank to another set of dies to form a tube over a mandrel. The mandrel is inserted into the dies after the first operation of forming the blank into a U shaped blank. After the second forming event, the mandrel is removed and the tube is passed through another die of smaller dimension than the tube to force the edges of the tube together and cause the edges to become parallel. After the tube is removed from this die, the natural spring in the metal causes the edges to spring away from each other and tend to open the joint. A plug and die is used to force the edges of the tube into engagement with each other in a phenomenon termed arching to set the edges together.

The present invention does not depend upon arching to close the joint. The present invention is further capable of making a tube with an inverted cross section and bends.

There is no showing that the invention of Small is capable of making tubes with inverted cross section.

Stolp, GB 129,983 discloses and apparatus and method for forming metal tubes from blanks of metal. The method includes forming a U shaped blank. A die is applied to the U shaped blank and an internal mandrel is then forced through the U shaped blank and the ends of the U shaped blank are bent around the mandrel in cooperation with the external forming dies to form a pipe having a cross section that matches the mandrel. Bending and creasing dies are used in successive fashion to finish the channel shaped member, still containing the internal mandrel, into a finished tube. The mandrel is then removed to form the tube.

Stolp differs from the present invention. Stolp does not include a mandrel integral with the dies. In addition, Stolp does not disclose making tubes with inverted cross sections having internally directed bends. Accordingly, the present invention differs from Stolp.

Black, U.S. Pat. No, 2,115,441 discloses a method of forming tubular structures from sheet metal, and particularly for use as frame members for truck bodies. Black describes a method for bending sheet metal into channels of various forms and angles without the use of mandrels leading up to a final die operation that bends the channel or semi formed tubular structure into a completed tube or semi-formed tubular structure from opposite sides and active on one side wall particularly through the open side of the channel.

Black differs from the present invention. Particularly, the present invention utilizes a mandrel to bend the metal in the die to assist in formation of a tube structure having and inverted irregular cross section. Black does not contemplate the formation of a tube with inverted cross section. In addition, the apparatus of Black does not include an internal mandrel to form the tube. Finally, there is no disclosure for forming a tube with inverted cross section and bends, such as is possible in the present invention.

Lowery et al, U.S. Pat. No. 5,657,922 discloses a method and apparatus for forming tapered, cylindrical poles from trapezoidal metal strips. The process is comprised of the steps of curling or pre-forming a trapezoidal blank, and then forming the preformed blank into a tubular shape by means of a shovel die. The tubular shaped blank is welded along a longitudinal seam such that a tubular pipe is formed. The resulting tapered cylindrical poles are used around highways, parking lots and playing fields to support lights or signs. The process can also be used to form thin walled cylindrical pipes.

Lowery does not disclose a method for forming a tubular structure with an inverted cross section, localized hardening, and bends. Moreover, the apparatus used by Lowery et al., does not include an internal mandrel integral with the die to form the tubular structure.

BRIEF SUMMARY OF THE INVENTION

The present invention is directed to an apparatus and method of forming a tube with an irregular shaped cross section and to the resulting irregular shaped cross section tubes. The method enables the manufacture of irregular shaped cross section tubes that could not be formed by conventional U&O forming processes and can eliminate post forming steps such as hydro-forming processes. The method comprises the steps of operatively positioning a metal blank of desired proportions in a die having a cooperative top portion and bottom portion to substantially form said blank into the desired tubular structure; said bottom portion opposite said blank. The blank may have apertures and be subjected to localized hardening prior to placing it into the die. The operator presses an internal mandrel integral to said die against the blank to force the blank into engagement with the bottom portion of the die to U form an intermediate shaped blank having opposed sides and an irregular shaped cross section conformable to cooperative profiles of said mandrel and said bottom portion of the die. The internal mandrel is configured such that it is removably included in said intermediate shaped blank. The top portion of the die is brought together with the bottom portion of the die to compress the legs of the U formed intermediate shaped blank against the inner mandrel cooperative with the top portion of the die to form a substantially closed tubular shaped blank with opposed edges and irregularly shaped cross section conformable to said profile between the bottom portion of the die and the mandrel with only a small longitudinal gap between opposing edges of the blank. The mandrel may be used to move the tubular shaped blank to a press and welding station where the tubular blank is removed from the mandrel and the blank is subjected to laser welding or other welding along the longitudinal gap to create the desired tube.

In another embodiment, the blank is first U shaped such that the legs of the U are slightly angled toward each other. The inner mandrel is then placed into the U shaped blank with slightly inwardly angled legs and used to transport the U shaped blank to the die. The mandrel is forced against the bottom of the die to form the irregular shaped cross section conformable to the profile of the bottom portion of the die. The top is then closed and the legs of the U shaped blank are formed into a tubular structure conformable to the profile of the top portion of the die such that the legs of the U shaped blank form opposing edges longitudinally along the length of the tubular shaped blank. The partially shaped blank is then transported to a welding station where opposing forces are placed on each of the opposing edges such that they are forced together, and welded. The welding process can be done with numerous welding processes most notably Mig, Tig, Laser welding and hybrid welding.

DETAILED DESCRIPTION OF THE INVENTION

Figure 1:
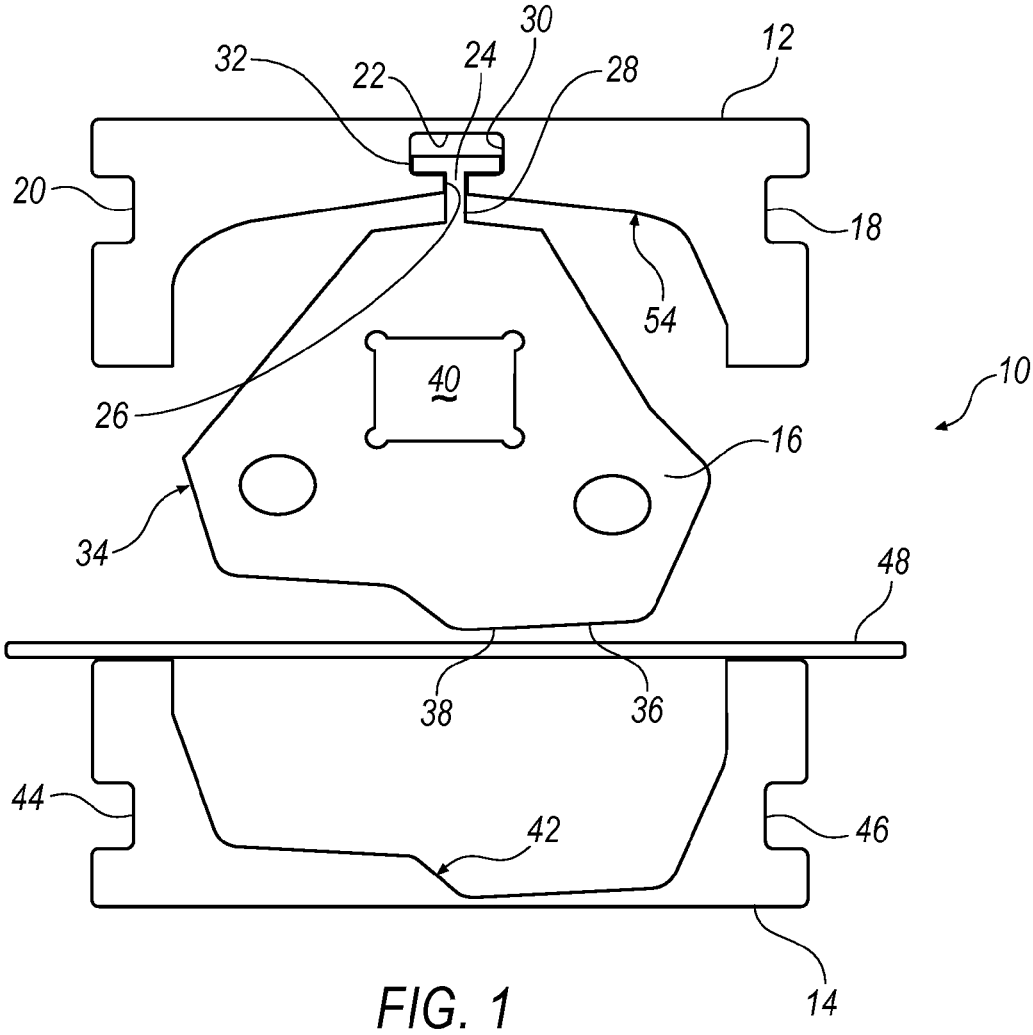
FIG. 1 is a sectional front view of the apparatus of the present invention in the open position.

Turning now to the drawings wherein like numbers refer to like structures, and particularly to FIG. 1, there is disclosed apparatus or tool die 10, having top portion 12, and a bottom portion 14 with a removable, integral hanging mandrel 16 disposed therebetween.

Top portion 12 is equipped with guide slots 18 and 20 that are adapted to be received onto rails in a press (not shown). The top portion is further equipped with a recess 22 that accepts locating surface 24 on mandrel 16. While the locating surface on the mandrel is shown having a T shape, it should be understood that any shaped locating surface is contemplated. The recess 22 is complementarily shaped to accommodate the locating surface, and includes a slot 26 to accommodate the stem 28 on the locating surface of the mandrel. The locating surface is removably positioned within the recess and the stem is positioned in the slot. Note that the transverse section 30 of the recess is of greater width 32 than the transverse section of the locating device. This permits the mandrel to move relative to the top portion in a manner to be hereinafter described.

Mandrel 16 has a perimeter 34 that includes an irregular shaped profile 36 along its bottom side 38. The mandrel may further be provided with various cut-outs 40 to decrease the weight of the mandrel and the amount of material used in the construction of the mandrel. The mandrel is designed to prevent the tube from buckling during processing or during bending of the tube.

The bottom portion 14 of the tool die 10 has a profile 42 complimentary to the profile of the mandrel. The bottom portion is opposite the top portion and is equipped with guide slots 44 and 46 to accept rails in a press.

Figure 2:
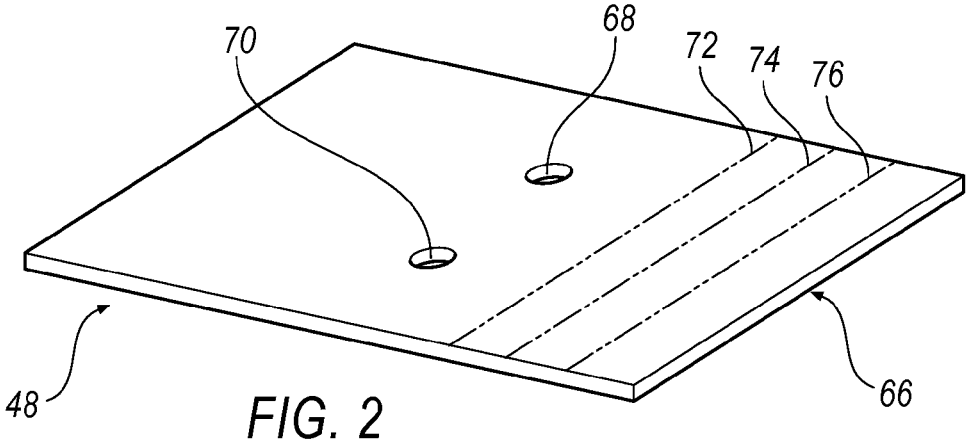
FIG. 2 is a perspective of a metal blank showing preformed options.

FIG. 2 shows a blank 48 of metal such as steel, iron, or other suitable material may be operatively positioned in the die, between the mandrel profile bottom and opposite profile of the bottom portion of the die. The metal blank is formed of desired dimensions to form a tubular construction of desired proportions. The blanks can have a variety of shapes and materials and thicknesses, and can be formed in a variety of ways. For example, the substantially flat blanks can be formed from a plurality of sub-blanks, formed with different materials, different thicknesses or welded together. The blank can have opposite longitudinal side edges that are not parallel to each other either along their entire length or along segments thereof. Some examples of different flat blanks that may be used in the present invention are disclosed in U.S. application Ser. No. 11/245,733 filed Oct. 8, 2005, and U.S. application Ser. No. 10/976,964 filed Oct. 29, 2004, incorporated herein in their entirety by reference. It should be noted that the blank may be equipped with features, such as apertures 68, 70 during the blanking operation to reduce the number of operations needed to be performed after the tube is formed. In addition, the metal blank may be subjected to localized hardening prior to formation into a tube. The tubular structure can be tuned for specific performance. Localized hardening imports improve crash force absorption, torsional rigidity and bending stiffness as later described herein.

Figure 3:
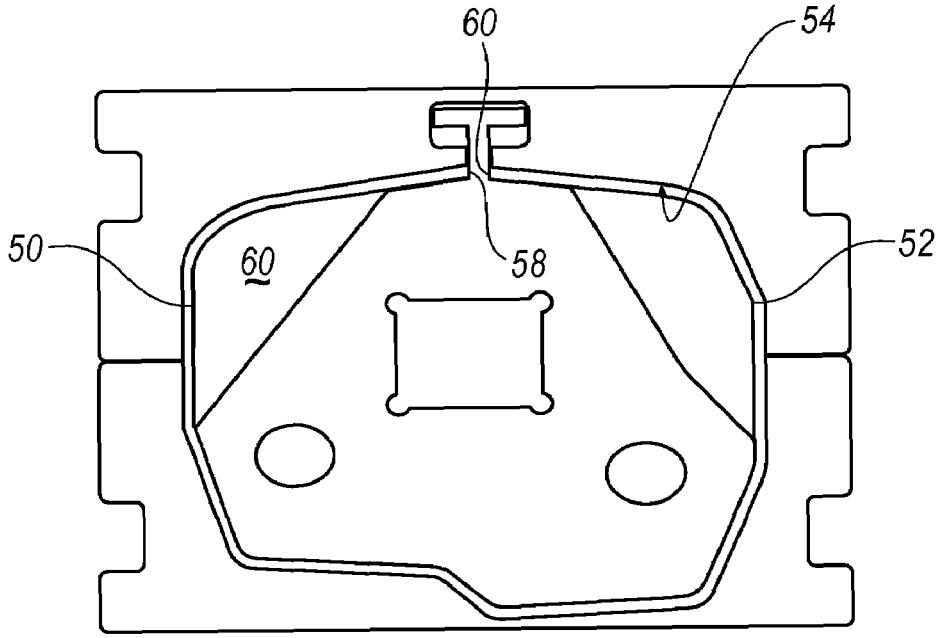
FIG. 3 is a sectional cross section of the apparatus of FIG. 1 in the closed position.

In operation, as seen in FIG. 3, the blank is operatively positioned between the mandrel profile and the bottom portion of the die. Because the guides accept rails in a press, the top portion of the blank is drawn to the bottom portion of the die by the press, and the mandrel encounters the blank. The mandrel forces the blank into engagement with the bottom portion profile of the tool die bottom, and forms a partially shaped tubular component having opposed sides 50 and 52 respectively. As the top portion continues to close, the opposed sides of the blank encounter the inner profile 54 of the top portion and the opposed sides are bent to form a tubular shaped structure having opposed edges 56 and 58. The opposed edges meet along the stem of the locating surface. When it is desired to move the tubular structure from the die to another processing station, the tool die is removed from the press and the top portion with the mandrel in the locating surface may be transported to another processing station with the mandrel in the interior 60 of the tubular structure. Thus, it can be understood that the inner mandrel can be used to assist transport of the tubular structure from one station to another processing station because the tube is curled around the inner profile of the top portion and engages either side of the stem of the locating surface. The inner mandrel is then slideably removed from the top and the longitudinally disposed opposed edges are pressed together at a press station to permit the seam 66 to be welded together to form a tubular structure. In the alternative, the hanging mandrel will preferably remain in the die set while the tubular structure is removed or ejected.

Figure 4:
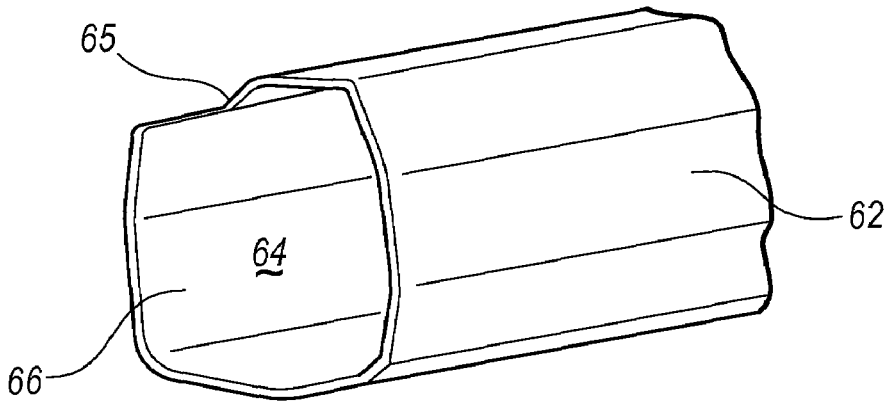
FIG. 4 is a sectional perspective view of a tubular structure with irregular inverted cross section formed using the apparatus of FIG. 1.

Turning to FIG. 4, the tube 62 formed by the process and apparatus of the present invention may have an inverted section 65 as well as an irregular cross section 64 and may be bent or otherwise formed without resort to hydro-forming. The hanging mandrel operates to support the tube from buckling in the areas where an inverted cross section is being formed.

In another embodiment, the blank can be placed into a die and formed into a U shaped cross section where the legs of the U shape are substantially parallel to each other prior to insertion into the die of FIG. 1 (or FIG. 3). In another embodiment, the blank can be shaped into a U shaped blank with the legs angled slightly inwardly toward each other. The over bending can be accomplished, for example, by including a mechanical feature in the die that pushes the straight legs inward while the die is in the fully closed position. Such an inwardly angled U shape can be beneficial, where there is a desire to support the U shape and by the U shaping die. For example, it may be beneficial to raise the U shape member above the U shaping die cavity on the U shaping die so that it can be slid off of the U shaping die into the next forming station. This can be particularly advantageous, for example, in sliding the U shape member directly across onto the internal mandrel. The inner mandrel can be position within the U shape blank with the opposed legs inwardly angled and used to transport the U shaped blank into the die of FIG. 1 (or FIG. 3), where the operations as described in regard to that figure are completed, thereby resulting in a tubular structure with an irregular cross section. The U shaping of the blank may be accomplished by any die means as is well known by persons of ordinary skill in the art and need not be recited here.

The tube formed according to the present invention further is designed with localized work hardening to provide significantly improved crash absorption stiffness and regional rigidity when the tubular structure is used as a structural element in a vehicle. Specifically, and referring to FIG. 2, the blank may be subjected to localized hardening around apertures 70 and 68 to eliminate the need to hardened apertures after tube formation. In addition, stiffness and regional rigidity may be enhanced by bending the blank at lines 72, 74 and 76, such that there is progressive crash force absorption as the tube deforms in response to the crush force. The forming process also provides sharp feature realization and enhances the function of the darts and embossments in the crush tip design.

The tool die is shown as modular in construction. Various modules may be assembled together to from a tool die of any desired length. It is further contemplated that the tool die not be modular, but may be construction of any desired length to form any tubular section of inverted cross section that may be desired.

The words used to describe the invention are words of description, and not words of limitation. Those skilled in the art will recognize that many modifications are possible without departing from the scope and spirit of the invention as set forth in the appended claims.

We claim:

1. An apparatus to form a tube having an irregularly shaped cross section, comprising:

a die having cooperative top portion and bottom portion and a hanging inner mandrel cooperative with said bottom portion of said die; said inner mandrel having a profile to facilitate creation of said irregular cross section cooperative with a profile of said bottom portion; said inner mandrel oriented to press a metal blank operatively positioned between said mandrel and said bottom portion into said bottom portion of said die to create an irregular cross section shape; said inner mandrel further oriented to be removed after said top portion of said die is closed to create a tubular formed blank; said tubular formed blank having opposed side edges; said mandrel having a locating surface removably retained within a complementary recess in said top die; said recess configured to permit the locating surface to travel longitudinally within the recess.

2. The apparatus of claim 1, further including a welding station to weld the opposed side edges of the tubular formed blank to create the tube with irregular cross section.

3. The apparatus of claim 2, wherein said welding station includes a press to force the opposed edges of said tubular formed blank together to facilitate welding.

4. The apparatus of claim 1, wherein said die is comprised of modular components to permit assembly of a die of any desired length.

5. The apparatus of claim 1, wherein said metal blank is that are equipped with apertures subjected to localized hardening; said blank further equipped with at least one bend along the length therewith to impart torsional rigidity and stiffness to said tube.

6. A modular apparatus to form a structural tube having an irregularly shaped cross section; said apparatus comprising:

a series of modular die components assembled together to present cooperative top portion and bottom portion and an inner mandrel cooperative with said bottom portion of said die; said inner mandrel having a profile to facilitate creation of said irregular cross section cooperative with a profile of said bottom portion; said inner mandrel oriented to press a metal blank operatively positioned between said mandrel and said bottom portion into said bottom portion of said die to create an irregular cross section shape; said inner mandrel further oriented to be removed after said top portion of said die is closed to create a tubular formed blank; said tubular formed blank having opposed side edges; said mandrel equipped with a locating surface of T shaped cross section, and the top portion component is equipped with a recess of complimentary form to accommodate said T shaped cross section mandrel locating surface.

7. The apparatus of claim 6, further including a welding station and a press to force the opposed edges of said tubular formed blank together to facilitate welding.

8. The apparatus of claim 6, wherein said metal blank is equipped with apertures subjected to localized hardening; said blank further equipped with at least one bend along its length to impart torsional rigidity and stiffness to said tube.

* * * * *